United States Patent [19]

Schreiber

[11] Patent Number: 4,932,060

[45] Date of Patent: Jun. 5, 1990

[54] STEREO ELECTROACOUSTICAL TRANSDUCING

[75] Inventor: William P. Schreiber, Ashland, Mass.

[73] Assignee: Bose Corporation, Framingham, Mass.

[21] Appl. No.: 29,991

[22] Filed: Mar. 25, 1987

[51] Int. Cl.[5] ..... H04R 5/02

[52] U.S. Cl. ..... 381/24; 181/145

[58] Field of Search ..... 381/1, 24, 27, 55, 99, 381/195; 181/155, 145

[56] References Cited

U.S. PATENT DOCUMENTS

| | | | |
|---|---|---|---|
| 3,129,783 | 4/1964 | Stowell | 181/145 |
| 3,965,295 | 6/1976 | Evans et al. | 381/55 |
| 4,199,657 | 4/1980 | Lane | 381/24 |
| 4,296,278 | 10/1981 | Cullison et al. | 381/55 |
| 4,315,102 | 2/1982 | Eberbach | 381/99 |
| 4,326,099 | 4/1982 | Maille | 381/24 |
| 4,408,095 | 10/1983 | Ariga et al. | 381/24 |
| 4,549,631 | 10/1985 | Bose | 181/155 |
| 4,586,192 | 4/1986 | Arntson | 381/195 |
| 4,691,362 | 9/1987 | Eberbach | 381/99 |
| 4,757,544 | 7/1988 | Guy | 381/90 |

FOREIGN PATENT DOCUMENTS 55-73197 6/1980 Japan .

*Primary Examiner*—Forester W. Isen

*Attorney, Agent, or Firm*—Fish & Richardson

[57] ABSTRACT

A woofer enclosure includes left and right input terminal pairs and left and right output terminal pairs. A protection circuit, woofer, satellite protection capacitor, satellite passive equalizer and light bulb intercouple the woofer enclosure input terminal pair and output terminal pair. Left and right satellite assemblies each include a lower enclosure and an upper enclosure with each enclosure including a single full-range driver. Each lower enclosure includes an input terminal pair connected to a respective output terminal pair of the woofer enclosure. A bypass capacitor is selectively connected across the driver in the lower enclosure. The upper enclosure driver is connected in series with the lower enclosure driver through a plug-and-jack connector.

28 Claims, 4 Drawing Sheets

STEREO ELECTROACOUSTICAL TRANSDUCING

The present invention relates in general to electroacoustical transducing and more particularly concerns novel apparatus and techniques for providing stereo reproduction with compact electroacoustical apparatus that is relatively inexpensive to fabricate, flexible in positioning and arrangeable to negligibly interfere with room decor.

It is an important object of this invention to provide improved stereo electroacoustical transducing apparatus.

According to the invention, there is dual-channel woofer means for radiating low frequency energy having spectral components below a predetermined lower middle frequency, typically 150 Hz, first and second satellite driver means for radiating acoustical energy above said predetermined lower middle frequency, and means for intercoupling a respective channel of said woofer means with a respective satellite driver means. Preferably each satellite driver means comprises top and bottom satellite driver means in separate enclosures operating above said predetermined lower middle frequency, and said subwoofer means includes dual-channel passive equalizing means for improving the frequency response of the satellite driver means.

Numerous other features, objects and advantages of the invention will become apparent from the following specification when read in connection with the accompanying drawing in which.

Figure 1:
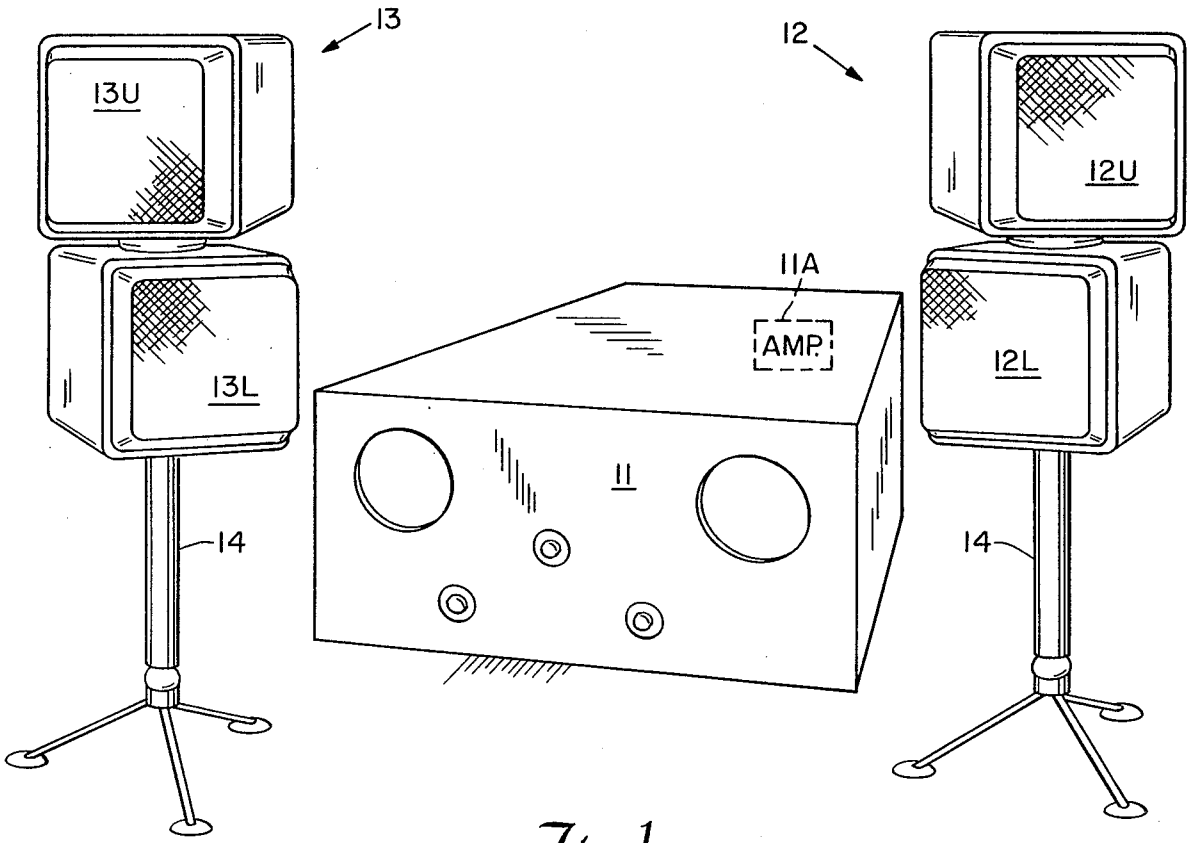
FIG. 1 is a perspective view of an embodiment of the invention showing left and right pairs of satellite enclosures and a common woofer enclosure.

With reference now to the drawing and more particularly FIG. 1 thereof, there is shown a perspective view of an embodiment of the invention comprising a dual-channel woofer enclosure 11, a right satellite pair 12 and a left satellite pair 13. Each satellite pair comprises an upper enclosure 12U, 13U, and lower enclosure 12L, 13L which may be supported on an arm, such as 14, to allow each enclosure to be oriented in a different direction to direct energy above 150 Hz toward the side predominantly for reflection into the listening area with some energy radiated directly into the listening area. Dual-channel woofer enclosure 11 contains left and right woofers preferably in an enclosure embodying the principles of U.S. Pat. No. 4,549, 631 granted to Amar G. Bose on Oct. 29, 1985, for MULTIPLE PORTING LOUDSPEAKER SYSTEMS. Woofer enclosure 11 may also include electronic powering means 11A indicated in dotted outline for powering the woofers and satellite pairs.

Figure 2:
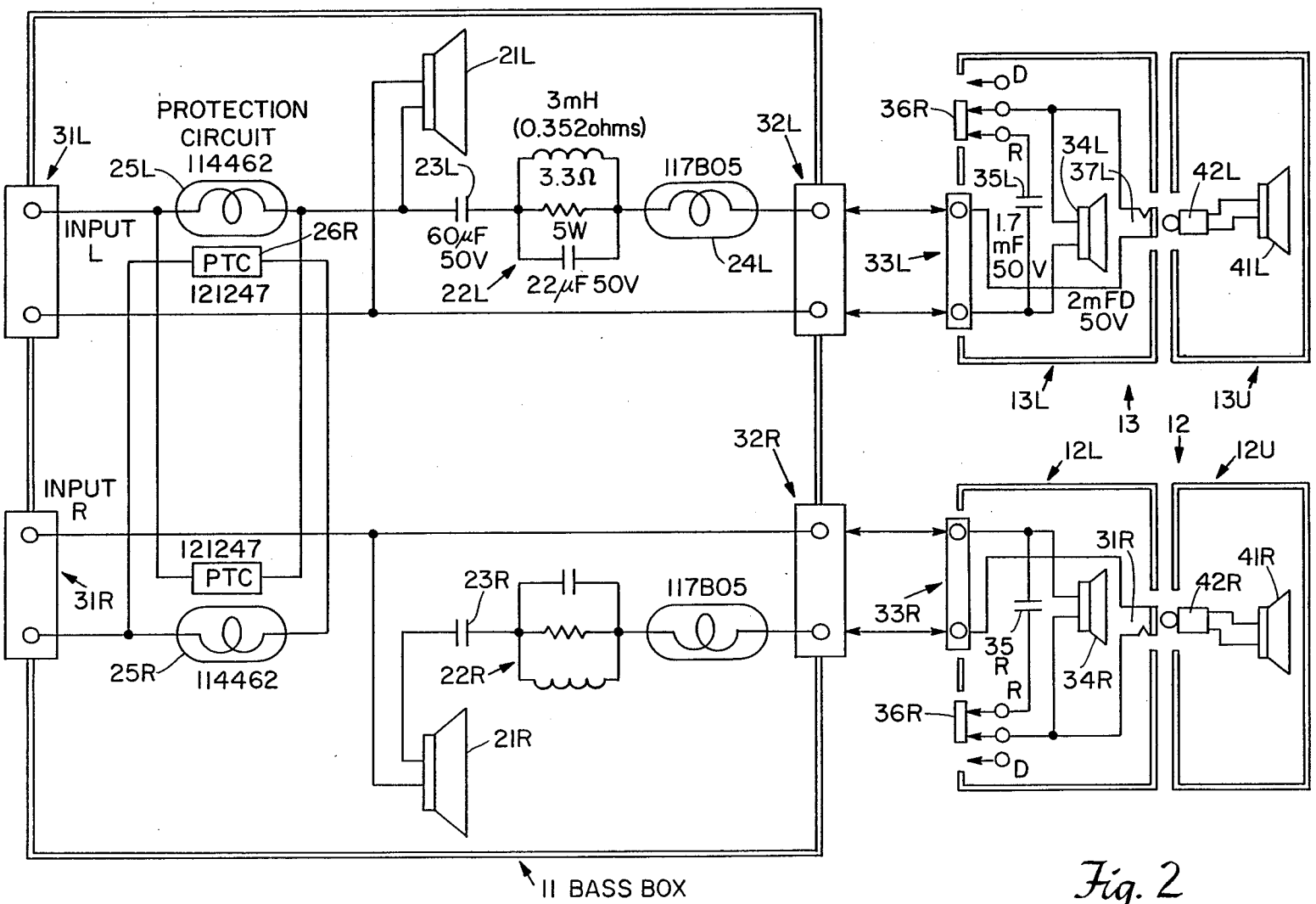
FIG. 2 is a combined schematic-diagrammatic representation of a preferred embodiment of the invention

Referring to FIG. 2, there is shown a combined schematic circuit-diagrammatic representation of a preferred embodiment of the invention showing the interconnecting relationship among dual-channel woofer enclosure 11 and right and left satellite pairs 12 and 13, respectively. Enclosure 11 includes left and right woofers 21L and 21R, respectively. The left and right channels include left and right satellite passive equalization networks 22L and 22R, respectively, capacitors 23L and 23R, respectively, and input light bulbs 25L and 25R adjacent to right and left protective circuits 26R and 26L, respectively. The elements described and a common line intercouple left and right input terminal pairs 31L and 31R, respectively, with output terminal pairs 32L and 32R, respectively.

Each output terminal pair 32L and 32R is connected to a respective input terminal pair 33L and 33R, respectively, of lower enclosures 13L and 12L, respectively. Each of these enclosures includes an upper frequency driver 34L and 34R, respectively, each of which has one terminal connected to one of the input terminals of input terminal pairs 33L and 33R, respectively, and the other terminal connected to one of the terminals of output jacks 37L and 37R, respectively. Each of the other terminals of output jacks 37L and 37R, respectively, are connected to the other terminal of input terminal pairs 33L and 33R, respectively. Each capacitor 35L and 35R is connected in parallel with each driver 34L and 34R, respectively, when each switch 36L and 36R, respectively, is in the R position as shown.

Left and right upper enclosures 13U and 12U, respectively, enclose left and right upper frequency drivers 41L and 41R, respectively, connected to left and right plugs 42L and 42R, respectively, which engage jacks 37L and 37R, respectively, to connect the left upper frequency drivers 34L and 41L and the right upper frequency drivers 34R and 41R, respectively, in series.

Moving switches 36L and 36R to the D position disconnects capacitors 35L and 35R from shunting drivers 34L and 34R, respectively, so that both upper frequency drivers in that channel radiate spectral components substantially equally.

Having briefly described the structural arrangement of the invention, principles of operation will be discussed. The invention basically comprises a stereophonic electracoustic transducing system having a woofer with dual satellite systems positioned to the left and right of the listener and oriented to radiate a portion of the upper frequency energy directly to the listener and a portion to the listener after reflection. Each satellite driver is a full-range driver, which may be of the type disclosed in U.S. Pat. Nos. 4,061,890, 4,158,756 and 4,577,069.

The woofer enclosure encloses both left and right bass transducers mounted internally on a baffle which divides the internal volume into first and second subshambers substantially in a 3:1 ratio, each volume ported such that the port tuned frequencies have substantially a 2:1 ratio, as described in the aforementioned U.S. Pat. No. 4,549,631. The in phase left and right low frequency outputs are acoustically summed by this arrangement. This summing of bass outputs is effective because (1) program material generally has little phase differentiation of left and right input signals below 150 Hz and (2) the non-localization phenomenon referred to below means that virtually no stereo imaging information is lost.

The bass spectral components of the left and right electrical input audio electrical signals are thus summed inside this dual-channel woofer enclosure having dual-channel woofer means mounted on the baffle to provide a summed bass acoustical signal for radiation by port means for radiating bass acoustical energy. The dual-channel woofer means and dual-channel woofer enclosure are characterized by an acoustic response that falls off sharply above a predetermined upper cutoff frequency in the lower range of audio frequencies for radiating in-phase bass spectral components of the left and right input audio electrical signals by the port means.

The performance advantages described in the aforementioned Bose U.S. Pat. No. 4,549,631 are threefold:

(1) Efficiency is above that of an optimized conventional ported system of the same size.

(2) The natural low pass filtering of the woofer enclosure allows for a steep rolloff above 150 Hz; because human auditory apparatus cannot easily localize on sound sources of frequencies band-limited below 150 Hz in a semi-reverberant environment (such as any real listening room), the woofer enclosure may be placed at or near a room corner, where bass efficiency is additionally increased by up to 6dB. This natural low pass filter characteristic is achieved without costly passive or active crossover networks and is thus less expensive than conventional embodiments of woofer/satellite systems.

(3) The excursion requirements of the woofer cone for a given acoustic output are reduced from that of a conventional ported system with the same size woofer. This reduction produces less distortion at high output power. In addition, distortion is further reduced by the low pass filtering mechanism of (2) above. This reduction in distortion components above 150 Hz is an important factor in realizing a sound source which is not easily localized even at high bass output levels.

The woofer is preferably designed for substantially flat power radiation into a typical room when 3 to 5 feet from a corner.

A feature of the invention is the interconnection in a manner that facilitates interconnection by unskilled users to avoid confusion. The inputs are on a block of four connector terminals 31L and 31R on woofer enclosure 11. The woofer enclosure includes the crossovers and equalizing networks for the satellite enclosures, and has two sets of two-connector push terminals 32L and 32R for the satellite enclosures 13 and 12, respectively.

The protection circuitry arrangement is another feature of the invention. When two low frequency transducers are located in a common volume, aberrations in frequency response and high excursion operation occur when one woofer is driven with a significantly different amplitude low frequency signal than drives the other. This phenomenon would occur if the protection circuit in one channel trips, causing attenuation of the signal to the woofer in that channel. By placing the lamp of the protection circuit in the tripped channel adjacent to the PTC (positive temperature coefficient) device of the untripped channel, the untripped channel is thereby caused to trip, thereby bringing the signals fed to each woofer back into balance.

The bottom satellite enclosures each have a set of two-connector input push terminals 33L and 33R, respectively, and a switch 36L and 36R, respectively, for selecting the R position shown attenuating the highfrequency output of the bottom enclosure while increasing the high-frequency output of the upper enclosure by 6 dB to provide predominantly reflected energy with the upper enclosure oriented to point away from the listener. In the D mode of switches 36L and 36R, both top and bottom enclosures have the same full spectrum output, although the high-frequency power response is reduced somewhat.

By having the top satellite enclosures 12U and 13U having phone plugs 42L and 42R for mating with jacks 37L and 37R, respectively, at the top of the bottom satellite enclosure, an easy, good connection is made for providing signal input to each upper enclosure while allowing rotation of the upper enclosure relative to the lower enclosure for selecting an appropriate radiation angle of each.

In an exemplary embodiment of the invention the woofer enclosure 11 includes two 6½-inch woofers 21L and 21R mounted in an enclosure having internal dimensions of 29 cm. high×15 cm. wide×48 cm. long. Woofers 21L and 21R both load a system as described in the aforesaid Bose U.S. Pat. No. 4,549,631 with a small chamber having a volume of 4.1 liters and a port measuring 6.4 cm. diameter by 13.0 cm. long with a port tuning frequency of 90 Hz. The large chamber has a volume of 12.4 liters and a port measuring 6.4 cm. diameter by 26.0 cm. long with a port tuning frequency of 45 Hz.

Each satellite assembly 12 and 13 consists of two enclosures each having a 60 mm driver with shielded magnet for lower flux leakage having internal dimensions of 7.4 cm. high×7.4 cm. wide×7.2 cm. deep forming a volume of 390 cc.

The invention is especially advantageous to use where space is restricted because the woofer enclosure 11 may be located anywhere in the listening area, even hidden behind or under funiture. Locating the woofer enclosure in a corner increases the bass efficiency of the system up to four times that of the same woofers in a conventionally placed enclosure. The satellite assemblies may be located on a bookshelf, suspended from the ceiling, supported by arms clamped to a desk, shelf or other piece of furniture or otherwise suitably located. Locating passive equalizing circuit components in the woofer enclosure helps keep the weight and volume of the satellite assemblies relatively low.

While it is preferred that the system include two or more enclosures for each satellite assembly, a number of advantages of the invention may be attained by using only one driver for each satellite assembly. It is also within the principles of the invention to use any number of woofers in the woofer enclosure, including a single woofer fed by a suitable means for combining the left and right channels, such as a two-winding voice coil.

This single woofer may be regarded as woofer driver means comprising a voice coil component with two separate windings energized by the left and right input signals,, respectively. Alternatively, woofer driver means may comprise at least two left and the same number of right woofers energized by the left and right input signals, respectively.

It is within the principles of the invention to include other components in the woofer enclosure. For example, the woofer enclosure might include a power amplifier, receiver, cassette player, compact disc player and/or other sources.

There may be electronic means for powering the woofer driver means and the satellite means comprising an electronically summed left and right signal means to provide a monaural signal to drive the woofer means.

Because the sound radiated by the woofer enclosure is largely unused by the listener for localizing in a listening room, the woofer enclosure may be located anywhere in the room near a convenient power outlet.

Figure 3:
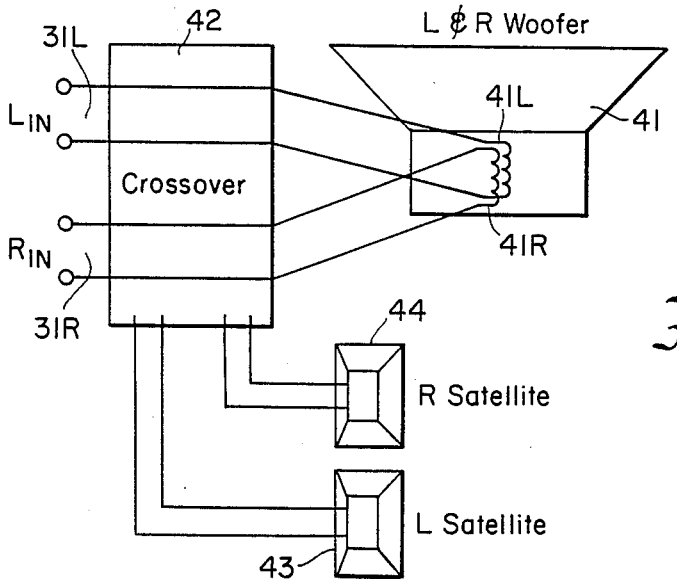
FIG. 3 is a combined block-schematic circuit diagram of an embodiment of the invention having a woofer with two voice coils.

Referring to FIG. 3, there is shown a combined block-schematic circuit diagram of an embodiment of the invention having a single woofer 41 with a left voice coil 41L and a right voice coil 41R that receives energy through crossover network 42 from left input terminal pair 31L and right input terminal pair 31R, respectively. Crossover network 42 energizes left and right satellite drivers 43 and 44, respectively.

Figure 4:
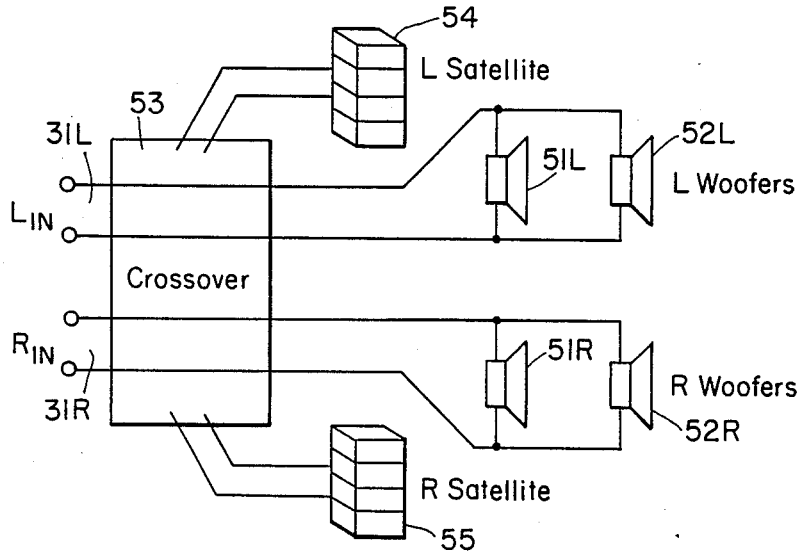
FIG. 4 is a combined block-schematic circuit diagram showing an embodiment of the invention having a pair of left woofers and a pair of right woofers.

Referring to FIG. 4, there is shown a combined block-schematic circuit diagram of still another embodiment of the invention having a left pair of woofers 51L and 52L and a right pair of woofers 51R and 52R receiving energy through crossover network 53 from input terminal pairs 31L and 31R, respectively. Crossover network 53 energizes left satellite driver 54 and right satellite driver 55.

Figure 5:
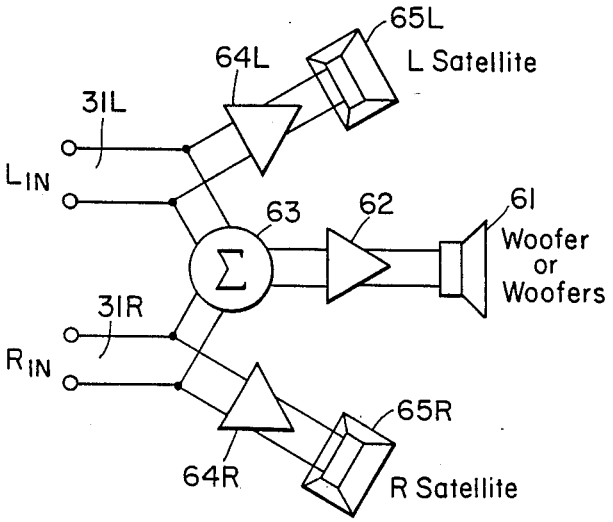
FIG. 5 is a schematic circuit diagram of an embodiment of the invention having a summer for providing a monaural signal that drives the woofer through an amplifier.

Referring to FIG. 5, there is shown a combined block-schematic circuit diagram of another embodiment of the invention having a woofer or woofers 61 energized with a monaural signal by power amplifier 62 energized by summing network 63 that electronically combines the left and right signals on input terminal pairs 31L and 31R, respectively. Left and right amplifiers 64L and 64R couple the left and right signals from input terminals 31L and 31R, respectively, to left and right satellite drivers 65L and 65R, respectively.

Figure 6:
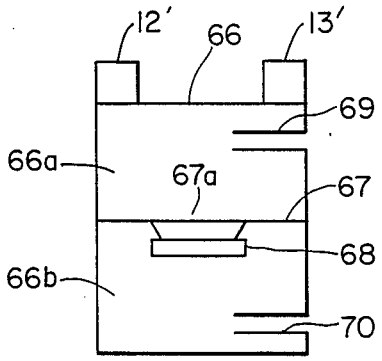
FIG. 6 is a diagrammatic representation of dual-channel woofer means mounted on a baffle inside a dual-channel woofer enclosure divided into first and second subchambers by the baffle with the satellites physically attached to the woofer enclosure.

Referring to FIG. 6, there is shown a diagrammatic representation of an embodiment of the invention comprising dual-channel woofer means **67*a* mounted on a baffle 67 inside a dual-channel woofer enclosure 66 divided into first and second subchambers 66*a* and 66*b*, respectively, by baffle 67 and having ports 69 and 70. Satellites 12' and 13' are physically attached to woofer enclosure 66**.

Figure 7:
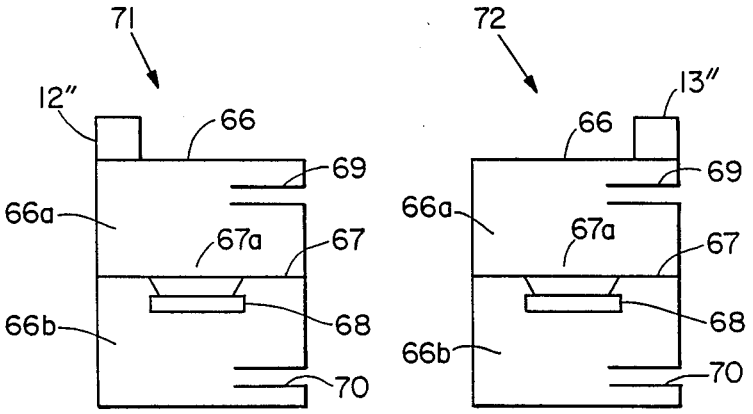
FIG. 7 is a diagrammatic representation of a system having left and right enclosures.
Figure 2:
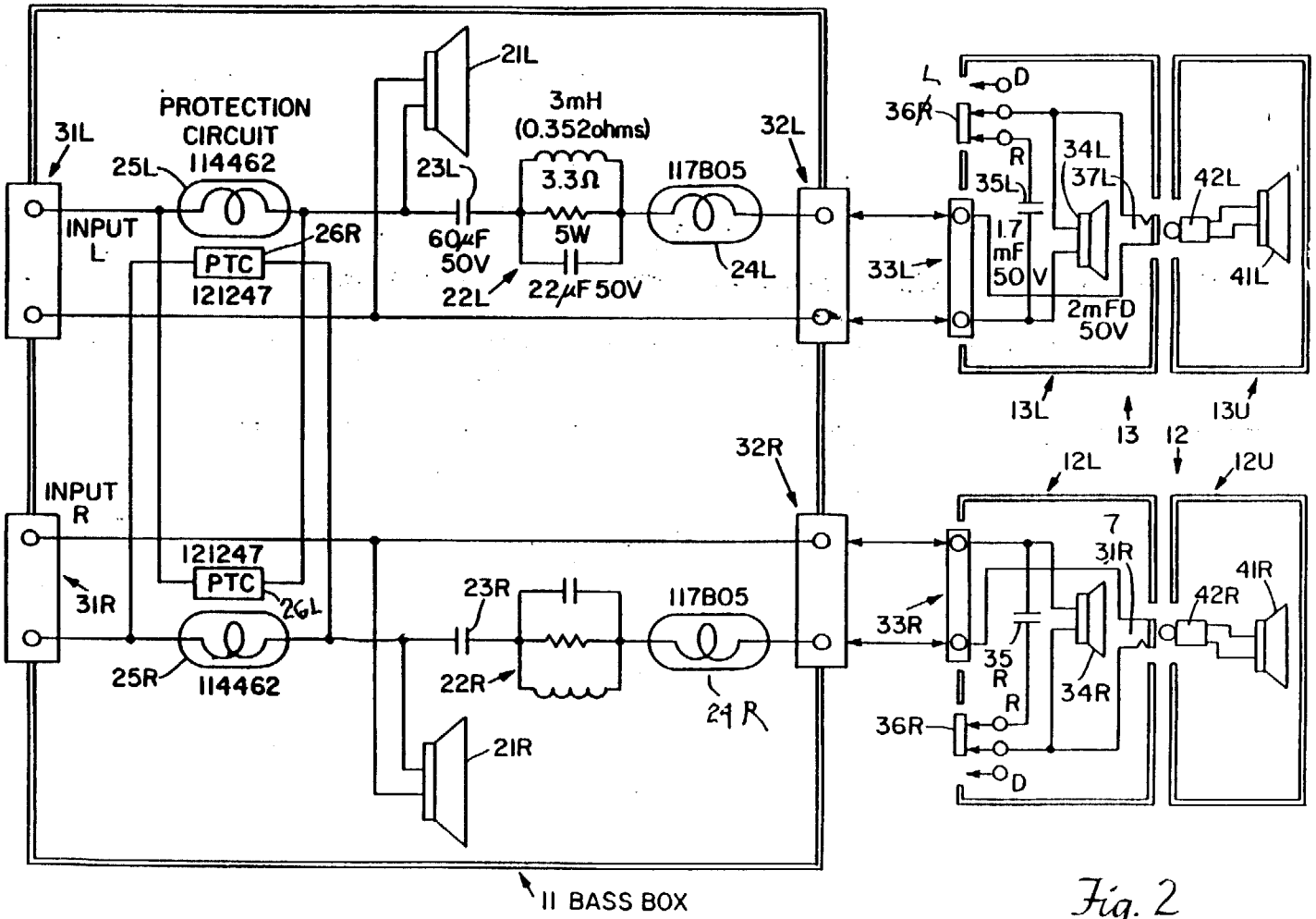
Figure 3:
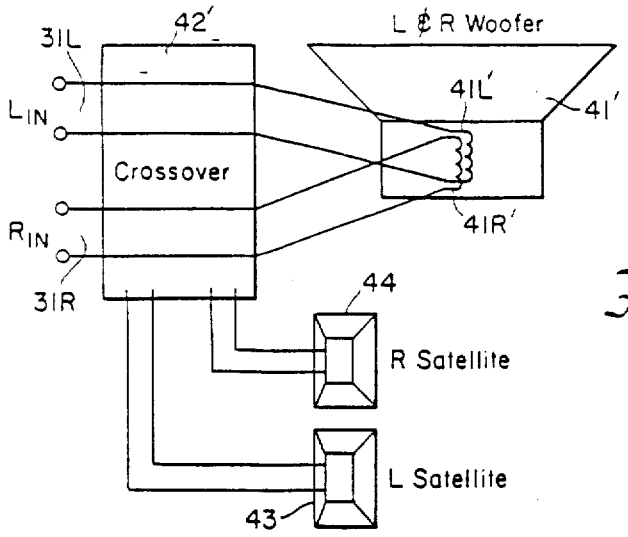
Figure 4:
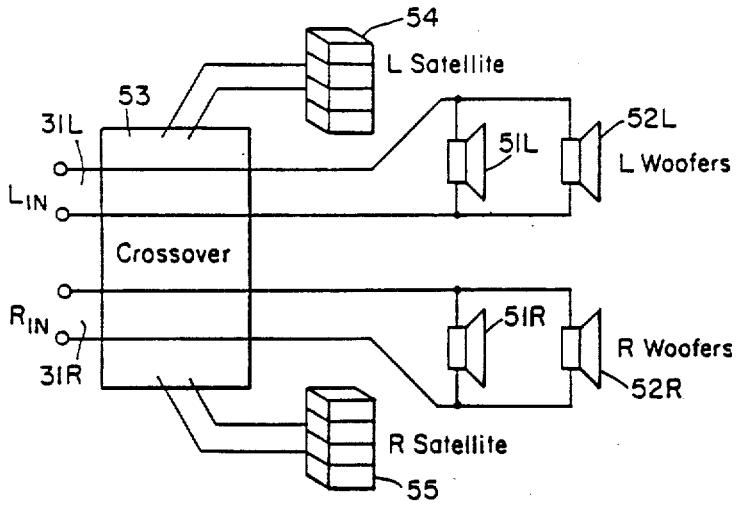
Figure 5:
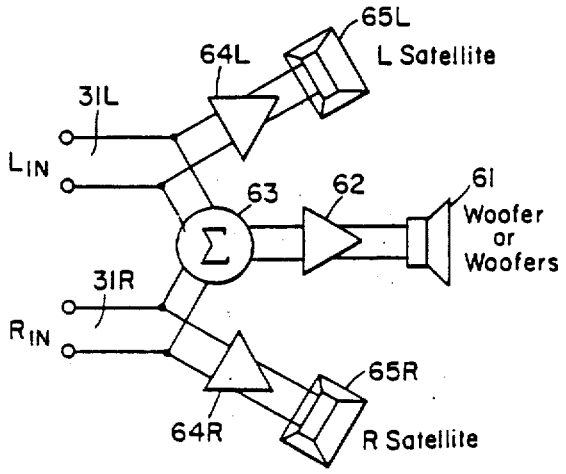

Referring to FIG. 7, there is shown a diagrammatic representation of a system according to the invention having a left woofer enclosure 71 and a right woofer enclosure 72 with satellites 12" and 13" physically attached to left and right enclosures 71 and 72, respectively.

It is also within the principles of the invention to locate a crossover/passive equalization network in a separate enclosure which could feed both the woofer enclosure and the satellite drivers.

It is within the principles of the invention to include two separate left and right channel bass enclosures, each with separate woofer means mounted internally between two ported volumes as described previously. It is also within the principles of the invention to include mid-frequency and high frequency transducers, or a combination mid and high frequency tranducers, on the outer surface of such a bass enclosure in order to provide for a complete left or right channel loudspeaker system.

It is evident that those skilled in the art may now make numerous other uses and modifications of and departures from the specific embodiments described herein without departing from the inventive concepts. Consequently, the invention is to be construed an embracing each and every novel feature and novel combination of features present in or possessed by the apparatus and techniques herein disclosed and limited solely by the spirit and scope of the appended claims.

What is claimed is:

1. Stereo electroacoustical transducing apparatus comprising, dual-channel woofer means mounted on a baffle inside a dual-channel woofer enclosure divided into first and second subchambers by said baffle and having port means for radiating bass acoustical energy for receiving left and right input audio electrical signals at first and second inputs, summing bass spectral components of said left and right input audio electrical signals to provide a summed bass acoustical signal for radiation by said port means and providing left and right output electrical signals, said dual-channel woofer means and said dual-channel woofer enclosure being characterized by an acoustic response that falls off sharply above a predetermined upper cutoff frequency in the lower range of audio frequencies for radiating in phase spectral components or said left and right input signals by said port means below said predetermined upper cutoff frequency, left and right satellite radiating means for radiating sound signals representative of said left and right output signals respectively, and means for coupling said left and right output electrical signals to said left and right satellite means respectively.

wherein said woofer means comprises a plurality of ports as the sole acoustic output means.

2. Stereo electroacoustical transducing apparatus in accordance with claim 1 wherein said woofer driver means comprises left and right woofers energized by said left and right input signals respectively.

3. Stereo electroacoustical transducing apparatus in accordance with claim 1 wherein said woofer means includes left and right passive equalizing means for equalizing said left and right satellite means respectively to provide a more uniform radiation response from said left and right satellite means.

4. Stereo electroacoustical transducing apparatus in accordance with claim 3 wherein said woofer driver means comprises left and right woofers energized by said left and right input signals respectively.

5. Stereo electroacoustical transducing apparatus in accordance with claim 1 wherein said woofer means is free of electrical crossover networks.

6. Stereo electroacoustical transducing apparatus in accordance with claim 5 wherein said predetermined upper cutoff frequency is substantially 150 Hz.

7. Stereo electroacoustical transducing apparatus in accordance with claim 1 wherein each of said satellite means comprises upper and lower enclosures each having a respective driver, and means for intercoupling the satellite means drivers.

8. Stereo electroacoustical transducing apparatus in accordance with claim 7 wherein the means for interconnecting the satellite means drivers comprises a plug-and-jack connector for electrically and mechanically connecting the upper and lower enclosures while allowing relative selectable angular displacement therebetween to control the relative direction of radiation from the satellite means drivers.

9. Stereo electroacoustical transducing apparatus in accordance with claim 7 wherein one of said satellite means enclosures includes means for selectively bypassing a predetermined range of spectral components from one of said satellite means drivers, while augmenting that same predetermined range of spectral components for the other satellite means driver.

10. Stereo electroacoustical transducing apparatus in accordance with claim 1 wherein said woofer means comprises dual ports as the sole acoustic output means.

11. Stereo electroacoustical transducing apparatus in accordance with claim 9 wherein said means for selectively bypassing comprises a switch.

12. Stereo electroacoustical transducing apparatus in accorance with claim 1 wherein said satellite means comprises a plurality of enclosures.

13. Stereo electroacoustical transducing apparatus in accordance with claim 1 wherein said woofer enclosure means includes electronic means for powering said woofer driver means and said satellite means.

14. Stereo electroacoustical apparatus according to claim 13, wherein said electronic means for powering said woofer driver means and said satellite means comprises an electronically summed left and right signal means to provide a monaural signal to drive the woofer means.

15. Stereo electroacoustical transducing apparatus in accordance with claim 1 wherein the left and right satellite radiating means comprises at least two transducers, each radiating different portions of the audio spectrum.

16. Stereo electroacoustical transducing apparatus in accordance with claim 1 wherein said woofer driver means comprises a voice coil component with two separate windings energized by said left and right input signals respectively.

17. Stereo electroacoustical apparatus according to claim 15 wherein the satellite radiating means is physically attached to the woofer means.

18. Stereo electroacoustical transducing apparatus in accordance with claim 4 wherein said woofer driver means comprises at least two left and the same number of right woofers energized by said left and right input signals respectively.

19. Stereo electroacoustical transducing apparatus in accordance with claim 4 and further comprising, means defining left and right channels for carrying left and right signals respectively representative of said left and right input signals, protection circuit means in each channel for attenuating signals in a respective channel in response to an overload condition, and means for intercoupling said circuit protection means in each channel with that of the other so that the occurrence of attenuation in one channel in response to an overload in that channel is accompanied by corresponding attenuation in the other channel so that the signals then fed through both channels are substantially in balance.

20. Stereo electroacoustic apparatus according to claim 1 wherein the satellite radiating means is physically attached to the woofer means.

21. Stereo electroacoustic apparatus according to claim 1 wherein said woofer enclosure means comprises separate left and right enclosures.

22. Stereo electroacoustical transducing apparatus in accordance with claim 1 wherein said upper cutoff frequency is sufficiently low so that human auditory apparatus cannot easily localize on said dual-channel woofer enclosure.

23. Stereo electroacoustical transducing apparatus comprising, dual-channel woofer means mounted on a baffle inside a dual-channel woofer enclosure divided into first and second subchambers by said baffle and having port means for radiating bass acoustical energy for receiving left and right input audio electrical signals at first and second inputs, summing bass spectral components of said left and right input audio electrical signals to provide a summed bass acoustical signal for radiation by said port means and providing left and right output electrical signals, said dual-channel woofer means and said dual-channel woofer enclosure being characterized by an acoustic response that falls off sharply above a predetermined upper cutoff frequency in the lower range of audio frequencies for radiating in phase spectral components of said left and right input signals by said port means below said predetermined upper cutoff frequency, left and right satellite radiating means for radiating sound signals representative of said left and right output signals respectively, and means for coupling said left and right output electrical signals to said left and right satellite means respectively, wherein said woofer enclosure includes electronic means for powering said woofer means and said satellite means, wherein said electronic means for powering said woofer means and said satellite means comprises an electronically summed left and right signal means to provide a monaural signal to drive the woofer means.

24. Stereo electroacoustical transducing apparatus comprising, a dual-channel woofer enclosure having left and right inputs for receiving left and right input aduio electrical signals, having a baffle dividing the internal volume of said enclosure into first and second subchambers, having port means for radiating bass acoustical energy and having left and right outputs for providing left and right output electrical signals, and dual-channel woofer means inside said dual-channel woofer enclosure coupled to said left and right inputs for receiving said left and right input audio electrical signals mounted on said baffle for summing bass spectral components of said left and right input audio electrical signals to provide a summed bass acoustical signal for radiation by said port means, said dual-channel woofer means and dual-channel enclosure being characterized by an acoustic response that falls off sharply above a predetermined upper cutoff frequency in the lower range of audio frequencies for radiating in phase transduced acoustic spectral components of said left and right input audio electrical signals below said predetermined upper cutoff frequency by said port means, wherein said woofer enclosure comprises a plurality of ports as the sole acoustic output means.

25. Stereo electroacoustical transducing apparatus in accordance with claim 24 and further comprising, left and right satellite radiating means for radiating sound signals representative of said left and right output signals respectively, and means for coupling said left and right outputs to said left and right satellite means respectively.

26. Stereo electroacoustical transducing apparatus in accordance with claim 25 wherein said upper cutoff frequency is sufficiently low so that human auditory apparatus cannot easily localize on said dual-channel woofer enclosure.

27. Stereo electroacoustical transducing apparatus comprising, dual-channel woofer means mounted on a baffle inside a dual-channel woofer enclosure divided into first and second subchambers by said baffle and having port means for radiating bass acoustical energy for receiving left and right input audio electrical signals at first and second inputs, summing bass spectral components of said left and right input audio electrical signals to provide a summed bass acoustical signal for radiation by said port means and providing left and right output electrical signals, said dual-channel woofer means and said dual-channel woofer enclosure being characterized by an acoustic response that falls off sharply above a predetermined upper cutoff frequency in the lower range of audio frequencies for radiating in phase spectral components of said left and right input signals by said port means below said predetermined upper cutoff frequency, left and right satellite radiating means for radiating sound signals representative of said left and right output signals respectively, and means for coupling said left and right output electrical signals to said left and right satellite means respectively, wherein each of said satellite means comprises upper and lower enclosures each having a respective driver, and means for intercoupling the satellite means drivers, wherein one of said satellite means enclosures includes means for selectively bypassing a predetermined range of spectral components from one of said satellite means drivers while augmenting that same predetermined range of spectral components for the other satellite means driver.

28. Stereo electroacoustical transducing apparatus in accordance with claim 27 wherein said satellite means comprises a plurality of enclosures.

* * * * *

UNITED STATES PATENT AND TRADEMARK OFFICE
CERTIFICATE OF CORRECTION

PATENT NO. : 4,932,060

DATED : June 5, 1990

INVENTOR(S) : William P. Schreiber

It is certified that error appears in the above-identified patent and that said Letters Patent is hereby corrected as shown below:

Column 5, lines 11-36 should read: --Referring to FIG. 3, there is shown a combined block-schematic circuit diagram of an embodiment of the invention having a single woofer 41' with a left voice coil 41L' and a right voice coil 41R' that receives energy through crossover network 42' from left input terminal pair 31L and right input terminal pair 31R, respectively. Crossover network 42' energizes left and right satellite drivers 43 and 44, respectively.

Referring to FIG. 4, there is shown a combined block-schematic circuit diagram of still another embodiment of the invention having a left pair of woofers 51L and 52L and a right pair of woofers 51R and 52R receiving energy through crossover network 53 from input terminal pairs 31L and 31R, respectively. Crossover network 53 energizes left satellite driver 54 and right satellite driver 55.

Referring to FIG. 5, there is shown a combined block-schematic circuit diagram of another embodiment of the invention having a woofer or woofers 61 energized with a monaural signal by power amplifier 62 energized by summing network 63 that electronically combines the left and right signals on input terminal pairs 31L and 31R, respectively. Left and right amplifiers 64L and 64R couple the left and right signals from input terminals 31L and 31R, respectively, to left and right satellite drivers 65L and 65R, respectively.--

UNITED STATES PATENT AND TRADEMARK OFFICE
CERTIFICATE OF CORRECTION

PATENT NO. : 4,932,060

DATED : June 5, 1990

INVENTOR(S) : William P. Schreiber

It is certified that error appears in the above-identified patent and that said Letters Patent is hereby corrected as shown below:

Column 6, line 25, "or" should read --of--.
Column 8, line 44, "aduio" should read --audio--.

Sheets 2 and 3 of the drawings bearing FIGS. 2-5 should appear in accordance with the attached sheets.

Signed and Sealed this

Twentieth Day of August, 1991

*Attest:*

HARRY F. MANBECK, JR.

*Attesting Officer*

*Commissioner of Patents and Trademarks*